US008525399B2

(12) United States Patent
Suzuki et al.

(10) Patent No.: US 8,525,399 B2
(45) Date of Patent: Sep. 3, 2013

(54) ELECTRON EMISSION ELEMENT INCLUDING DIAMOND DOPED WITH PHOSPHORUS

(75) Inventors: Mariko Suzuki, Yokohama (JP); Tadashi Sakai, Yokohama (JP); Naoshi Sakuma, Yokohama (JP); Masayuki Katagiri, Kawasaki (JP); Yuichi Yamazaki, Inagi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 14 days.

(21) Appl. No.: 12/888,650

(22) Filed: Sep. 23, 2010

(65) Prior Publication Data

US 2011/0050080 A1 Mar. 3, 2011

Related U.S. Application Data

(63) Continuation of application No. PCT/JP2009/052492, filed on Feb. 16, 2009.

(30) Foreign Application Priority Data

Mar. 28, 2008 (JP) ..... 2008-086152

(51) Int. Cl.
*H01J 63/04* (2006.01)

(52) U.S. Cl.
USPC ..... 313/310

(58) Field of Classification Search
USPC ..... 313/309–311
See application file for complete search history.

(56) References Cited

U.S. PATENT DOCUMENTS

| | | | | |
|---|---|---|---|---|
| 5,631,196 | A * | 5/1997 | Kane et al. | 438/20 |
| 2003/0038587 | A1* | 2/2003 | Onishi | 313/496 |
| 2005/0062392 | A1 | 3/2005 | Sakai et al. | |
| 2008/0042144 | A1* | 2/2008 | Tatsumi et al. | 257/77 |
| 2008/0160872 | A1 | 7/2008 | Sakai et al. | |
| 2008/0203885 | A1 | 8/2008 | Ono et al. | |
| 2011/0221328 | A1* | 9/2011 | Nemanich et al. | 313/355 |

FOREIGN PATENT DOCUMENTS

| | | |
|---|---|---|
| JP | 2000-223006 | 8/2000 |
| JP | 2007-042604 | 2/2007 |

OTHER PUBLICATIONS

International Search Report for PCT/JP2009/052492 mailed on Mar. 24, 2009.
Written Opinion for PCT/JP2009/052492.
Kock, et al. Enhanced low-temperature thermionic field emission from surface-treated N-doped diamond films, Diamond and Related Materials 11, pp. 774-779 (2002).
Twitchen, et al. High-Voltage Single-Crystal Diamond Diodes, IEEE Transactions on Electron Devices, vol. 51, No. 5, May 2004.
Koizumi, et al. Ultraviolet Emission from a Diamond pn Junction, Science, vol. 292, pp. 1899-1901, Jun. 8, 2001.

* cited by examiner

*Primary Examiner* — Anh Mai
*Assistant Examiner* — Hana Featherly
(74) *Attorney, Agent, or Firm* — Turocy & Watson, LLP

(57) ABSTRACT

According to the embodiment, an electron emission element includes a conductive substrate, a first diamond layer of a first conductivity type formed on the conductive substrate, and a second diamond layer of the first conductivity type formed on the first diamond layer. Thereby, it becomes possible to provide the electron emission element having a high electron emission amount and a high current density even in a low electric field at low temperature and the electron emission apparatus using this electron emission element.

7 Claims, 4 Drawing Sheets

ELECTRON EMISSION ELEMENT INCLUDING DIAMOND DOPED WITH PHOSPHORUS

CROSS-REFERENCE TO RELATED APPLICATION

This is a Continuation application of PCT Application No. PCT/JP2009/052492, filed Feb. 16, 2009, which was published under PCT Article 21(2) in Japanese.

This application is based upon and claims the benefit of priority from Japanese Patent Application No. 2008-086152, filed Mar. 28, 2008; the entire contents of which are incorporated herein by reference.

FIELD

Embodiments described herein relate generally to an electron emission element using a diamond.

BACKGROUND

The diamond attracts attention as a semiconductor light-emitting material since it has excellent potential semiconductor characteristic or optical characteristics in addition to mechanical, chemical and thermal characteristics. In particular, since it has negative electron affinity or very small electron affinity, an application to an electron source device that emits electrons from a surface thereof is expected. Further, it has a band gap of approximately 5.5 eV at room temperature, a possibility as a light-emitting element that emits light in an ultraviolet region or robust crystallinity, and hence an application to a high-power device is expected.

As an example of using the diamond as an electron source, a cold cathode using a boron-doped diamond is known. Further, field electron emission from a phosphorus-doped diamond has been also reported. There is also an example of thermionic electron emission from a nitrogen-doped diamond. The diamond is also utilized as an electron source using a PN junction, and the diamond is expected as a thermionic electron emission source at low temperature in particular. For instance, a Schottky diode of the diamond is known as an example of utilizing the diamond as a high-power element, an LED based on a PN junction of the diamond is known as an example of utilizing the diamond as a light-emitting element.

However, since the donor level formed by nitrogen is as deep as 1.7 eV in the nitrogen-doped diamond, resistance is higher than those of other semiconductors at low temperature in particular, and injection of charges, contact with an electrode or energization with a substrate is a serious problem. In particular, since a diamond substrate has a relatively high resistance, discontinuity emerges when Si or any other metal such as Mo having a lower resistance is utilized as a substrate because of a great difference in characteristics between the substrate material and the diamond, which is a cause of an increase in electrical resistance. Therefore, an electron emission amount is lowered in an electron source, current density is decreased in an electron device, and operating voltage is increased or light-emitting efficiency is reduced in a light-emitting device. In the phosphorus-doped diamond, the donor level formed by phosphorus is as small as 0.6 eV as compared with nitrogen, and electrons tend to flow at low temperature as compared with the nitrogen-doped diamond. Therefore, the phosphorus-doped diamond is the most promising thermionic electron emission source, but an example of observation of thermionic electron emission in a low electric field at low temperature has not been actually reported, and such emission has not been observed in experiments conducted by the present inventors.

In view of the above-described problem, it has been desired to provide an electron emission element that can obtain a high electron emission amount and a high current density even in a low electric field (e.g., 0.01 V/μm or below) at low temperature (e.g., 1000° C. or below) and to provide an electron emission apparatus using this electron emission element.

DETAILED DESCRIPTION

In general, according to one embodiment, an electron emission element includes a conductive substrate, a first diamond layer of a first conductivity type formed on the conductive substrate, and a second diamond layer of the first conductivity type formed on the first diamond layer.

According to the present embodiments, it is possible to provide the electron emission element having a high electron emission amount and a high current density even in a low electric field at low temperature and the electron emission apparatus using this electron emission element.

Embodiments will now be described hereinafter with reference to the drawings. It is to be noted that the drawings are schematic views and the relationship between thickness and planar dimension, the ratio of the thickness of each layer and others are different from actual values. Therefore, specific thicknesses or dimensions should be judged in the light of the following explanation. Furthermore, it is to be noted that the drawings include portions having different dimensional relationships or different ratios. Moreover, a first conductivity type is determined as n-type.

First Embodiment

Figure 1:
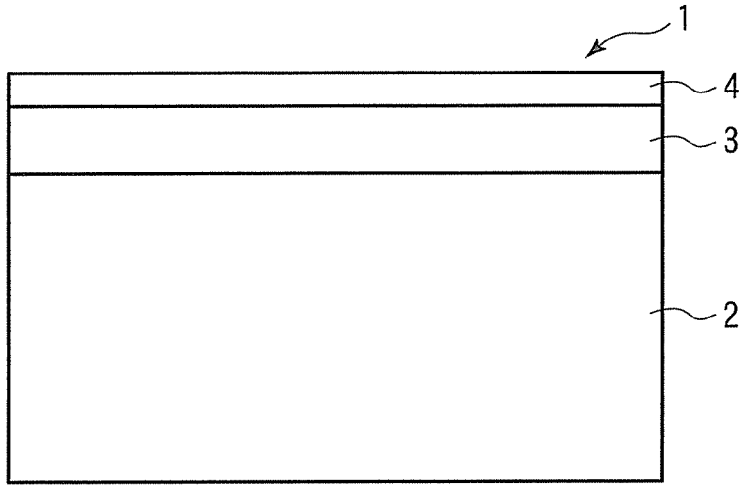
FIG. 1 is a cross-sectional view of an electron emission element according to a first embodiment.

FIG. 1 is a cross-sectional view of an electron emission element according to a first embodiment. As shown in the drawing, in an electron emission element 1 according to the first embodiment, a first diamond layer 3 is arranged on a substrate 2, and a second diamond layer 4 as an electron emission layer is arranged on the first diamond layer 3. It is preferable for the substrate 2 to be formed of a material having conductivity, and it is constituted of, e.g., an Si substrate. The first diamond layer 3 is a semiconductor layer containing a phosphorus (P)-doped diamond crystal as a main component, and either a single crystal or a polycrystal can be used for this layer. The second diamond layer 4 is a semiconductor layer containing a nitrogen (N)-doped diamond crystal as a main component, and either a single crystal or a polycrystal can be used for this layer.

To increase an efficiency of the electron emission element, the present inventors tried providing the phosphorus-doped diamond layer 2 between the nitrogen-doped diamond semiconductor layer (electron emission layer) 4 and the conductive substrate 2. As a result, they discovered that electrical continuity between the conductive substrate 2 and each of the diamond crystal layers 3 and 4 can be improved, resistance in a direction vertical to the conductive substrate 2 can be decreased and thermionic electron emission at low temperature in a low electric field, which cannot be acquired when using the phosphorus (P)-doped diamond as the electron emission layer, can be obtained.

In an electron emission element having a semiconductor layer whose material is different from that of a substrate, a discontinuous region tends to be produced between the semiconductor layer and the substrate and, in particular, a large electrical gap is generated and current is obstructed when a semiconductor layer having a large band gap is to be bonded. Especially, when the donor level is deep, a Fermi level is also present at a position that is deep from the conduction band bottom, and a large gap is produced between conduction bands near the junction, whereby electrons are hardly injected into the semiconductor layer from the substrate.

Figure 2A:
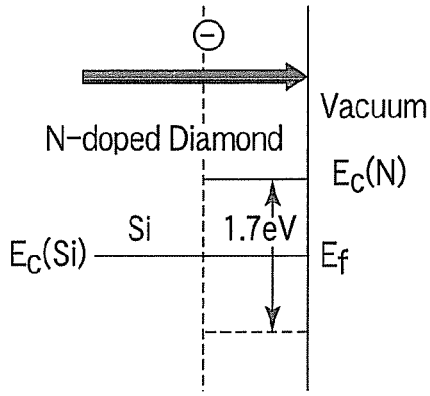
FIG. 2A is a view for schematically explaining by using an energy band an energy level in a conventional electron emission element having an N-doped diamond layer formed on an Si substrate.

In FIG. 2A, energy levels when a nitrogen (N)-doped diamond (N-doped diamond) (center) is formed on the Si substrate (left-hand side) are schematically compared, the right-hand side shows a vacuum, and electrons are emitted toward the vacuum as indicated by an arrow. Further, the comparison is made with the Si substrate and the N-doped diamond having the same Fermi level (Ef). Ec(Si) and Ec(N) represent the conduction band bottom of Si and the conduction band bottom of the N-doped diamond, respectively. Since the donor level of the N-doped diamond is as deep as 1.7 eV as described above, its resistance is higher than those of other semiconductors.

Figure 2B:
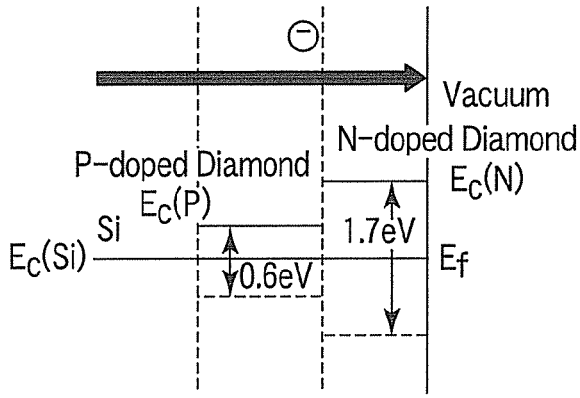
FIG. 2B is a view schematically explaining a reason why the electron emission element according to the first embodiment has low-resistance characteristics by using the energy band.

In FIG. 2B, energy bands when an N-doped diamond layer is formed on the Si substrate (left-hand side) through the P-doped diamond layer are schematically compared, the right-hand side shows a vacuum, and electrons are emitted toward the vacuum as indicated by the arrow. Furthermore, the comparison is made with the Si substrate, the P-doped diamond layer and the N-doped diamond layer having the same Fermi level (Ef) (junction state). Ec(P) represents the conduction band bottom of P. The donor level of the P-doped diamond is as small as 0.6 eV as compared with N, and hence a current can readily flow.

When the P-doped diamond layer having a shallower donor level is interposed between the substrate and the N-doped diamond layer, the conduction bands are gradually joined, and electrons can be readily injected. Therefore, a highly efficient diamond electron emission element can be obtained with low resistance at low temperature in a low electric field.

Figure 3A:
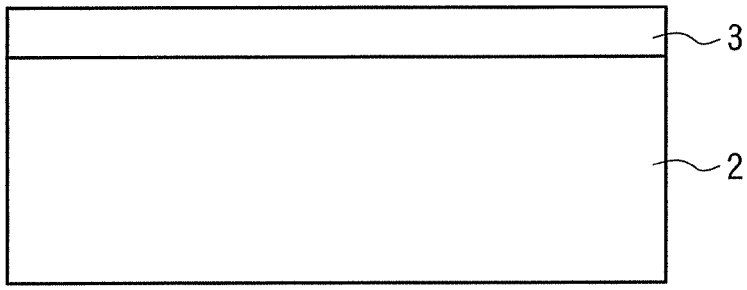
FIG. 3A is a cross-sectional view for explaining a manufacturing process of the electron emission element according to the first embodiment.

A manufacturing method of an electron emission element according to the first embodiment will now be described with reference to FIGS. 3A and 3B. First, as shown in FIG. 3A, methane gas ($CH_4$) as a carbon raw material, hydrogen gas ($H_2$) as a carrier gas and a raw material of phosphorus as a dopant, e.g., phosphine are made to flow onto the n-type Si substrate 2 by the plasma CVD method, thereby forming the first diamond semiconductor layer 3 with a thickness of 150 nm. At this time, the substrate temperature is 900° C., the flow rate of the methane gas is 2 sccm, the flow rate of the hydrogen gas is 1 slm, the plasma output is 1000 W, and the reaction tube pressure is 30 Torr. Although a concentration of $1\times10^{20}/cm^3$ is desired for the phosphorus, the concentration must be greater than or equal to $1\times10^{18}/cm^3$ and greater than the concentration of nitrogen which is present as a residual impurity.

Figure 3B:
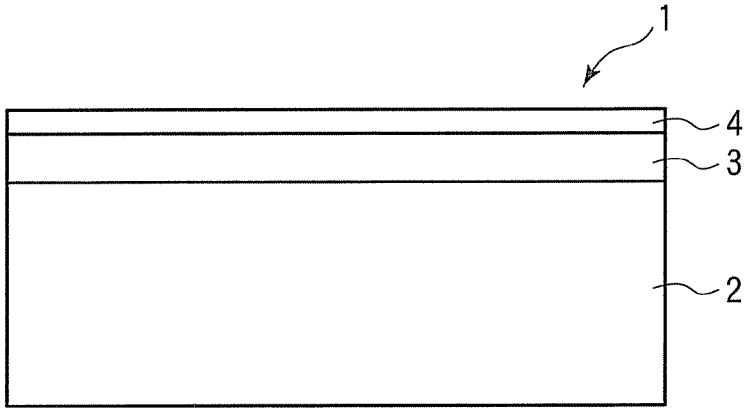
FIG. 3B is a cross-sectional view of a process following FIG. 3A.

Then, as shown in FIG. 3B, the methane gas, the hydrogen gas and a raw material of nitrogen, e.g., nitrogen gas, are made to flow onto the first diamond semiconductor layer 2, whereby the second semiconductor layer 4 formed of a diamond having nitrogen doped therein is formed as an electron emission layer with a thickness of 100 nm. At this time, the substrate temperature is 900° C., the flow rate of the nitrogen gas is 20 sccm, the flow rate of the hydrogen gas is 1 slm, the plasma output is 1000 W, and the reaction tube pressure is 30 Torr. Although a concentration of $1\times10^{20}/cm^3$ is desired for the nitrogen, a concentration that is greater than or equal to $1\times10^{19}/cm^3$ can suffice.

Figure 4:
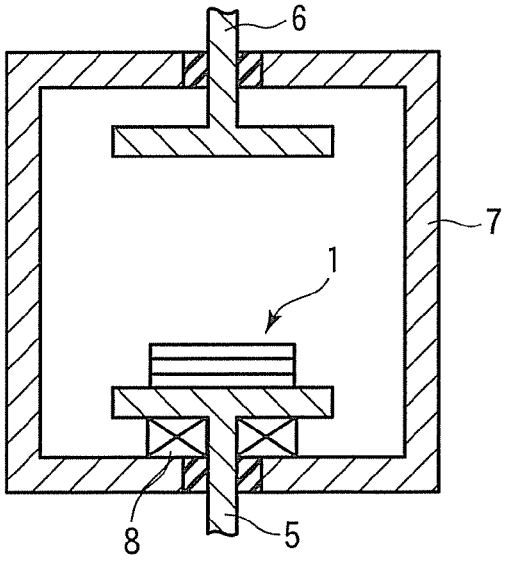
FIG. 4 is a structural view for measuring characteristics of the electron emission element depicted in FIG. 1 and it is a view showing a basic configuration of an electron emission apparatus.

As shown in FIG. 4, the thus created electron emission element 1 is introduced into a hermetic container 7 having a cathode 5 and an anode which face each other, and it is installed on the cathode 5. A vacuum is formed in the hermetic container 7, the electron emission element 1 is heated to 300° C. by heating means 8, and a potential is applied to a portion between the cathode 5 and the anode 6. In the above-described apparatus, a configuration and an operation of an actual electron emission apparatus are imitated.

It is to be noted that and an electron emission apparatus such as a display apparatus, an illumination apparatus or a recording apparatus can be formed with the configuration depicted in FIG. 4 being used as a basic configuration.

In the above-described state, when a current was made to flow through the second diamond layer 4 as the electron emission layer through the substrate 2 and the first diamond layer 3, a thermionic electron emission current was observed from a relatively low voltage of approximately several volts. Moreover, when the element was heated to 600° C., a current of $4\times10^{-4}$ A/cm$^2$ was obtained with 100 V.

Figure 5:
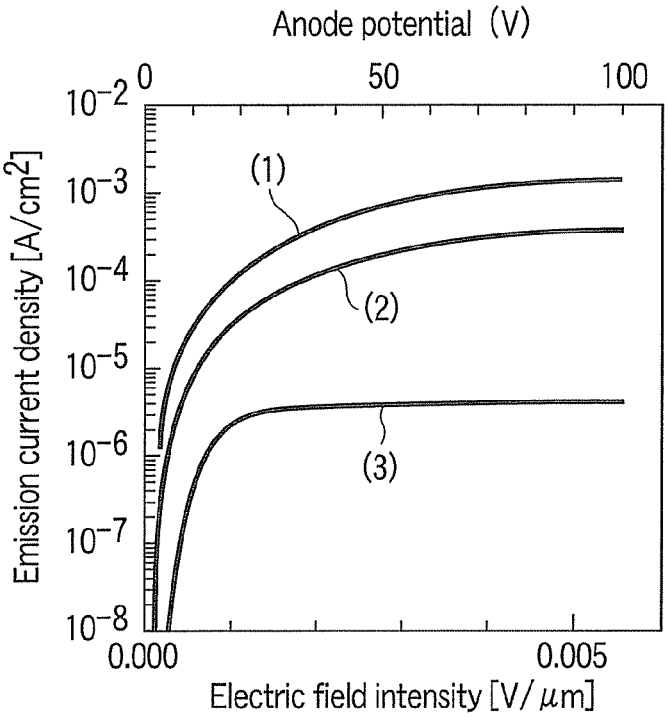
FIG. 5 is a characteristic view of an electric field intensity—an emission current density of the electron emission element according to the first embodiment.

FIG. 5 shows a relationship between electric field intensity, anode potential and emission current density when the electron emission element, the N-doped diamond layer and the P-doped diamond layer according to this embodiment were heated to approximately 600° C. As shown in FIG. 5, the element according to this embodiment indicated as curve (1) had a value which is, at the same temperature, approximately triple the value indicated as curve (2) when the second diamond semiconductor layer (N-doped diamond layer) alone was used as an electron emission plane without providing the first diamond semiconductor layer (P-doped diamond layer). It is to be noted that curve (3) represents a case where the P-doped layer diamond semiconductor layer was used as an electron emission plane as a comparative example. It is to be noted that heating temperatures at the time of acquiring data of the curves (1), (2) and (3) are 600, 668 and 670° C., respectively.

Figure 6A:
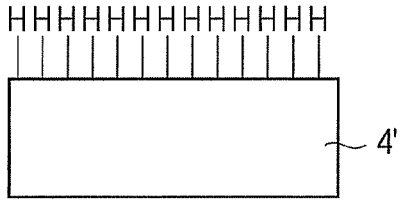
FIG. 6A is a view schematically showing a hydrogen termination face of an N-doped diamond layer.
Figure 6B:
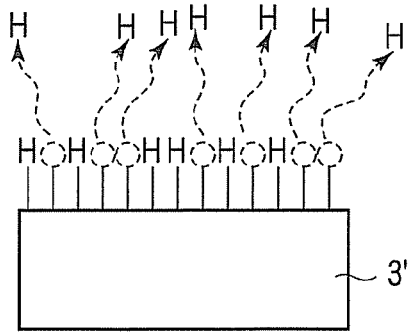
FIG. 6B is a view schematically showing a hydrogen termination face of a P-doped diamond layer.

Although a reason why the N-doped diamond layer surface has electron emission characteristics higher than those of the P-doped layer diamond surface has not been determined in detail, it can be presumed that hydrogen termination of the surface concerns. FIG. 6A schematically shows a surface state of the nitrogen-doped diamond layer, and hydrogen termination is stable and this state is not jeopardized until a high temperature is reached, i.e., a state that negative electron affinity is stable is maintained. FIG. 6B schematically shows a surface of the P-doped diamond layer, and it depicts a state that the hydrogen termination is lost even at low temperature, i.e., the negative electron affinity is unstable.

As described above, according to the first embodiment, since the N-doped diamond layer is formed on the conductive substrate through the P-doped diamond layer, the conduction bands are gradually joined, and the electron emission element and the electron emission apparatus having the high electron emission amount and the high current density can be provided.

Second Embodiment

Figure 7:
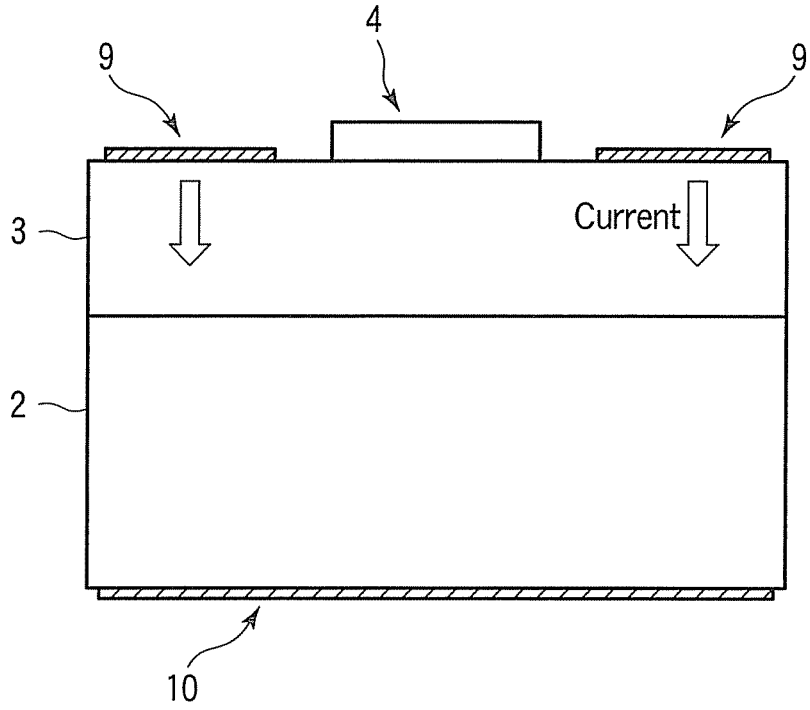
FIG. 7 is a cross-sectional view of an electron emission element according to a second embodiment.

FIG. 7 is a schematic cross-sectional view of an electron emission element with a built-in heater according to a second embodiment. The second embodiment is different from the first embodiment in that a second diamond layer 4 is selectively removed, an upper (first) electrode 9 is provided on each portion from which the second diamond layer 4 is removed and a lower (second) electrode 10 is provided on a lower surface of an n-type Si substrate 2. Other elements are equivalent to those in the first embodiment, and hence like reference numbers denote these elements to avoid a tautological explanation.

As each of the electrodes 9 and 10 in this embodiment, a laminated electrode of, e.g., Ti/Pt/Au can be used. Ti with a thickness of 500 nm is formed on the diamond layer, Pt with a thickness of 500 nm is formed thereon, Au with a thickness of 2000 nm is further formed thereon, and annealing is carried out at 700° C. for approximately 10 minutes, thereby forming an alloy layer between Ti and the diamond.

In the electron emission element depicted in FIG. 7, when a potential is applied to a portion between the electrodes 9 and 10, a current flows through the first diamond layer 3 and the silicon substrate 2, and the second diamond layer (electron emission layer) 4 can be heated by self-heating of these members. At this time, an impurity concentration between the first diamond layer 3 and the Si substrate 1 and the potential applied to the portion between the electrodes can be appropriately adjusted so that the second diamond layer (electron emission layer) 4 can have a temperature of 600° C. or above.

The above-described element can be applied to an electron emission apparatus having the configuration depicted in FIG. 4. That is, the electron emission element 1 in FIG. 4 is substituted by the electron emission element in FIG. 7, and the electrode 10 and the cathode 5 are united. When such a configuration is adopted, the heating means 8 can be built into the electron emission element, thereby providing the electron emission element having the simplified configuration for heating the elements.

The electron emission element according to the present embodiments can be mainly applied to a planar display apparatus, an illumination apparatus and a recording apparatus which are generally extensively used as well as an X-ray tube.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electron emission element comprising:

a conductive substrate having a first main surface and a second main surface;

a first diamond layer of a first conductivity type formed on the first main surface of the conductive substrate;

a second diamond layer of the first conductivity type formed on a first portion of a first main surface of the first diamond layer, wherein the first main surface of the first diamond layer is opposite the second main surface of the first diamond layer which is in contact with the first main surface of the conductive substrate;

a first electrode formed on a second portion of the first main surface of the first diamond layer, wherein the first portion of the first main surface of the first diamond layer is disparate to the second portion of the first main surface of the first diamond layer; and a second electrode formed on the second main surface of the conductive substrate, so as to sandwich the conductive substrate and the first diamond layer in series between the first electrode and the second electrode, wherein, in the event of application of electric power between the first electrode and the second electrode, the first diamond layer and the conductive substrate are self-heated by current flowing therethrough, thereby heating the second diamond layer.

2. The electron emission element according to claim 1, wherein phosphorus is doped in the first diamond layer.

3. The electron emission element according to claim 1, wherein nitrogen is doped in the second diamond layer.

4. An electron emission apparatus comprising:

a hermetic envelope;

a cathode provided in the hermetic envelope;

an electron emission element which comprises:

a conductive substrate which has a first main surface and a second main surface and is mounted on the cathode so that electrical conduction is achieved between the second main surface and the cathode;

a first diamond layer of a first conductivity type formed on the first main surface of the conductive substrate;

a second diamond layer of the first conductivity type formed on a first portion of a first main surface of the first diamond layer, wherein the first main surface of the first diamond layer is opposite the second diamond layer which is in contact with the first main surface of the conductive substrate; and an energizing electrode formed on a second portion of the first main surface of the first diamond layer is disparate to the second portion of the first main surface of the first diamond layer; and an anode provided in the hermetic envelope to face the second diamond layer to be spaced apart from the second diamond layer, wherein, in the event of application of electric power between the energizing electrode and the cathode, the first diamond layer and the conductive substrate are self-heated by current flowing therethrough, thereby heating the second diamond layer.

5. The electron emission apparatus according to claim 4, wherein phosphorus is doped in the first diamond layer.

6. The electron emission apparatus according to claim 4, wherein nitrogen is doped in the second diamond layer.

7. The electron emission apparatus according to claim 4, wherein a vacuum is maintained in the hermetic envelope.

* * * * *